United States Patent [19]

Daigler

[11] 4,054,620

[45] Oct. 18, 1977

[54] COLD ENRICHMENT THERMOSTAT ENCLOSURE

[75] Inventor: Frank A. Daigler, Lockport, N.Y.

[73] Assignee: General Motors Corporation, Detroit, Mich.

[21] Appl. No.: 745,127

[22] Filed: Nov. 26, 1976

[51] Int. Cl.[2] ..... F02M 1/10

[52] U.S. Cl. ..... 261/39 B; 123/119 F; 236/101 C; 403/397

[58] Field of Search ..... 261/39 B, 39 E; 403/397; 123/119 F; 236/101 C, 101 D; 267/53

[56] References Cited

U.S. PATENT DOCUMENTS

| | | | |
|---|---|---|---|
| 2,093,961 | 9/1937 | Ericson | 261/39 B |
| 2,479,392 | 8/1949 | Miller | 236/101 |
| 2,646,933 | 7/1953 | Boyce | 261/39 B |
| 2,902,307 | 9/1959 | Skay | 292/256.6 |
| 3,055,686 | 9/1962 | Havener | 403/397 |
| 3,180,576 | 4/1965 | Herman | 261/39 B |
| 3,210,004 | 10/1965 | Hunt et al. | 236/101 |
| 3,276,800 | 10/1966 | Loudon et al. | 403/397 |
| 3,529,585 | 9/1970 | Stoltman | 261/39 B |
| 3,828,745 | 8/1974 | Medrick | 123/119 F |

FOREIGN PATENT DOCUMENTS

| | | | |
|---|---|---|---|
| 526,241 | 6/1956 | Canada | 261/39 B |

*Primary Examiner*—Tim R. Miles

*Attorney, Agent, or Firm*—C. K. Veenstra

[57] ABSTRACT

In a carburetor choke assembly having a coiled bimetal thermostat enclosed between a housing and a cover, the cover is retained on the housing by a plurality of spring clips which are hooked to the housing and have a serrated edge gripping the cover.

3 Claims, 5 Drawing Figures

COLD ENRICHMENT THERMOSTAT ENCLOSURE

This invention relates to a cold enrichment thermostat enclosure adapted for use on an internal combustion engine and more particularly to such an enclosure having the thermostat disposed between a housing and a cover which are retained in assembly by a spring clip.

Cold enrichment mechanisms used on internal combustion engines commonly have a coiled bimetal thermostat which positions either a carburetor choke valve or another fuel metering system. The thermostat is usually disposed in a housing and mounted on a cover that is rotatable on the housing to establish initial calibration. That calibration is then maintained by tabs which engage the cover and are held in place by screws threaded into the housing.

This invention provides a thermostat enclosure in which retention of the cover to the housing requires fewer pieces and thus is both a less expensive and a less cumbersome construction for assembling and calibrating the cold enrichment mechanism. With this invention, the cover is assembled to the housing and the initial calibration is established in the usual manner, and rotation of the cover on the housing is then prevented by a spring clip which hooks to the housing and has a serrated edge gripping the cover.

The details as well as other objects and advantages of this invention are set forth in the remainder of the specification and are shown in the drawing in which.

Figure 1:
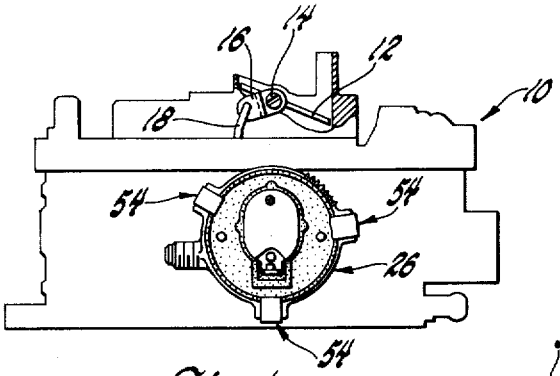
FIG. 1 is a side elevational view of a carburetor having this new thermostat enclosure.
Figure 2:
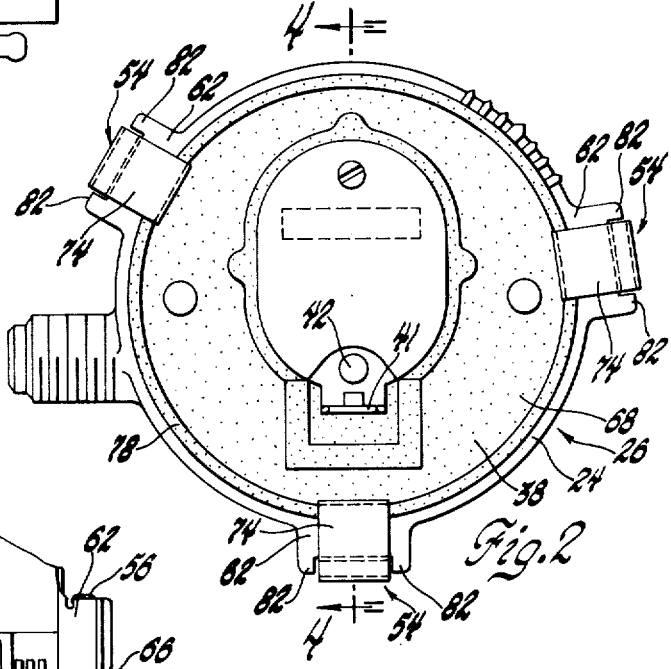
FIG. 2 is a side elevational view of this new thermostat enclosure separated from the carburetor and enlarged to better illustrate the spring clips.
Figure 3:
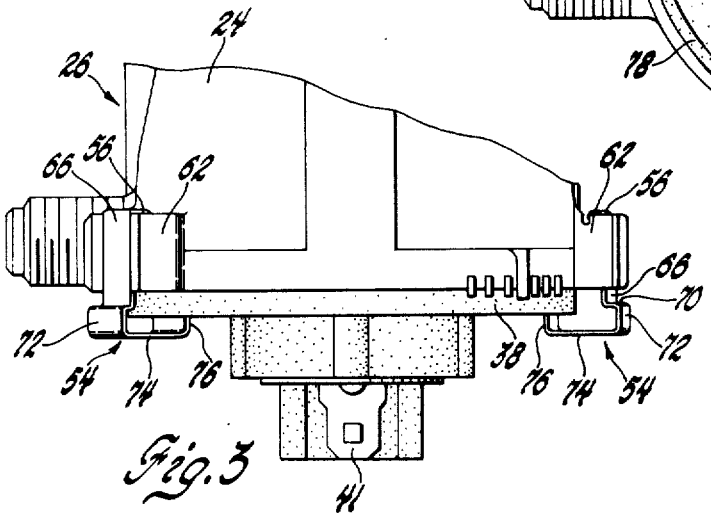
FIG. 3 is a top plan view of the FIG. 2 thermostat enclosure further illustrating the spring clips.
Figure 4:
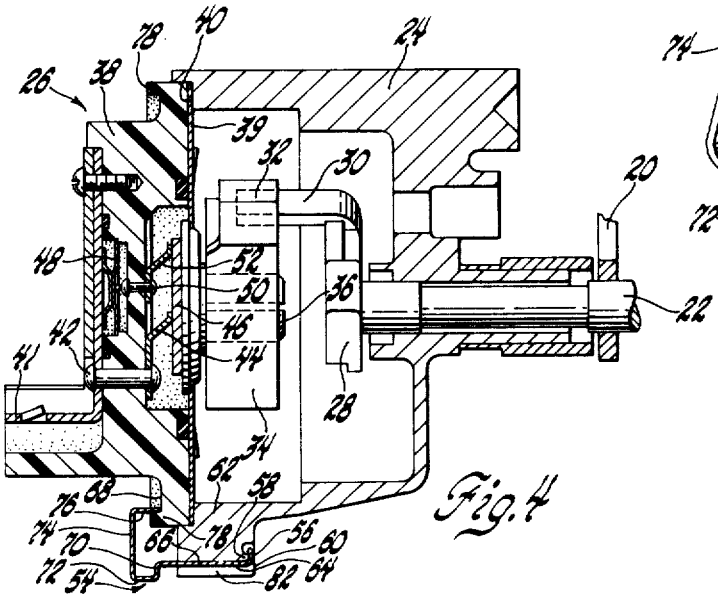
FIG. 4 is an axial sectional view taken along line 4—4 of FIG. 2 showing the internal details of the thermostat enclosure.

Referring first to FIG. 1, a carburetor 10 has a choke valve 12 secured on a choke shaft 14 to which a choke lever 16 is also secured. A choke rod 18 connects choke lever 16 to an intermediate lever 20 which, as shown in FIG. 4, is secured on an intermediate shaft 22 mounted in the back of a housing 24 which forms a portion of a thermostat enclosure 26.

A thermostat lever 28 is secured on intermediate shaft 22 within housing 24 and has a tab 30 bent to engage the hooked end 32 of a coiled bimetallic thermostat 34. Thermostat 34 is mounted on a stud 36 carried by a cover 38 which is assembled with its inner surface 39 overlying the front surface 40 of housing 24.

While the thermostat may be heated by hot air, exhaust gases or engine coolant, the particular heating arrangement shown here uses electrical power. Current is supplied through the spade connection 41, a rivet 42 and a contact 44 to a portion of a positive temperature coefficient heating element 46 which transfers heat through stud 36 to thermostat 34. Under certain higher temperature conditions of operation, current is also supplied through connection 41 and a bimetallic switch 48, a rivet 50 and a second contact 52 to a second portion of heating element 46 to increase the heat transfer through stud 36 to thermostat 34.

The structure described thus far is well-known and need not be recited in detail. As is common, intermediate shaft 22 may also operate other linkage to control a fast idle cam and to regulate operation of the secondary stage of the carburetor. In other applications, intermediate shaft 22 may operate another fuel metering system in place of choke valve 12.

Figure 5:
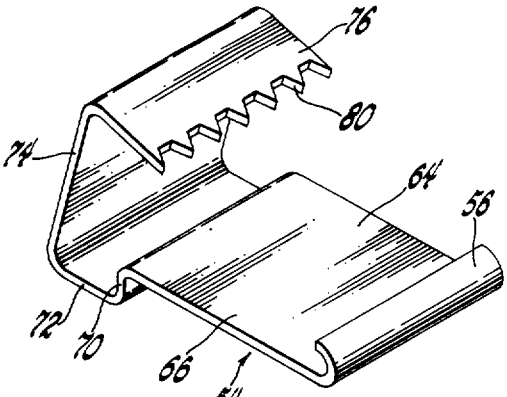
FIG. 5 is an enlarged pictorial view of the spring clip removed from the enclosure assembly.

In the illustrated embodiment, cover 38 is retained in assembly with housing 24 by three spring clips 54. Each spring clip 54 has a hooked portion 56 which embraces a lip 58 on the rear surface 60 of each of the rim portions 62 of housing 24. A shank portion 64 of each spring clip 54 has a first section 66 extending axially from hooked portion 56 approximately to the plane of the outer surface 68 of cover 38. A second section 70 of the shank portion 64 of each spring clip 54 extends radially outwardly from the first section 66 of shank portion 64. A third section 72 extends axially from the second section 70 beyond the outer surface 68 of front cover 38, and a cantilever portion 74 extends radially inwardly over cover 38. A gripping portion 76 extends axially from cantilever portion 74 toward the outer surface 68 of cover 38 inside a peripheral ridge 78 extending axially about cover 38. Gripping portion 76 has a serrated edge 80 (shown in FIG. 5) engaging the outer surface 68 of cover 38.

Serrated edge 80 prevents rotation of cover 38 under spring clip 54, and circumferentially spaced radial projections 82 disposed on housing 24 on each side of each clip 54 prevent movement of clips 54 about housing 24. This construction thus prevents rotation of cover 38 on housing 24 and accordingly maintains the initial calibration of the cold enrichment mechanism.

In practice, cover 38 is assembled to housing 24 and rotated thereon to establish the initial closing force on choke valve 12, the hook portions 56 of clips 54 are hooked over the lips 58 on the rear surfaces 60 of housing rim portions 62, and the cantilever portions 74 of spring clips 54 are pulled outwardly to allow the gripping portions 76 of spring clips 54 to pass over the peripheral ridge 78 on the outer surface 68 of cover 38 and then released to engage the serrated edges 80 of spring clips 54 with the outer surface 68 of cover 38.

The embodiments of the invention in which an exclusive property or privilege is claimed are defined as follows:

1. A cold enrichment thermostat enclosure adapted for use on an internal combustion engine, said enclosure comprising a housing having a rim portion with axially spaced front and rear surfaces, a cover having axially spaced inner and outer surfaces, said inner surface of said cover overlying said front surface of said housing rim portion, a thermostat enclosed between said housing and said cover, and a spring clip retaining said cover in assembly with said housing, said clip including a hook portion engaging said rear surface of said housing, a shank portion extending axially from said hook portion beyond the plane of said outer surface of said cover, a cantilever portion extending radially inwardly from said shank portion over said cover, and a gripping portion extending axially from said cantilever portion toward said outer surface of said cover and having a serrated edge engaging said outer surface to preclude rotary motion of said cover under said clip, said housing further having means engaging said clip to prevent movement of said clip about said housing, whereby said cover is retained against rotation on said housing.

2. A cold enrichment thermostat enclosure adapted for use on an internal combustion engine, said enclosure comprising a housing having a rim portion with axially spaced front and rear surfaces, a cover having axially spaced inner and outer surfaces, said inner surface of said cover overlying said front surface of said housing rim portion, a thermostat enclosed between said housing and said cover, and a spring clip retaining said cover in assembly with said housing, said clip including a hook portion engaging said rear surface of said housing, a shank poriton having a first section extending axially from said hook portion approximately to the plane of said outer surface of said cover, a second section extending radially outwardly from said first section, and a third section extending axially from said second section beyond the plane of said outer surface of said cover, a cantilever portion extending radially inwardly from said shank portion over said cover, and a gripping portion extending axially from said cantilever portion toward said outer surface of said cover and having a serrated edge engaging said outer surface to preclude rotary motion of said cover under said clip, said housing further having means engaging said clip to prevent movement of said clip about said housing, whereby said cover is retained against rotation on said housing.

3. A cold enrichment thermostat enclosure adapted for use on an internal combustion engine, said enclosure comprising a housing having at least two circumferentially spaced rim portions with axially spaced front and rear surfaces, a cover having axially spaced inner and outer surfaces, said inner surface of said cover overlying said front surface of said housing rim portions, a thermostat enclosed between said housing and said cover, each of said rear surfaces of said housing rim portions having a lip extending axially away from said cover, said outer surface of said cover having a peripheral ridge extending axially away from said housing and a spring clip associated with each of said housing rim portions for retaining said cover in assembly with said housing, each of said clips including a hook portion embracing said lip of the associated housing rim portion, a shank portion having a first section extending axially from said hook portion approximately to the plane of said outer surface of said cover, a second section extending radially outwardly from said first section, and a third section extending axially from said second section beyond the plane of said outer surface of said cover, a cantilever portion extending radially inwardly from said third section of said shank portion beyond said cover ridge, and a gripping portion extending axially from said cantilever portion toward said outer surface of said cover and having a serrated edge engaging said outer surface to preclude rotary motion of said cover under said clip, said housing further having circumferentially spaced projections extending radially on each side of each of said clips to prevent movement of said clips about said housing, whereby said cover is retained against rotation on said housing.

* * * * *